United States Patent [19]

Schmidt, Jr. et al.

[11] 4,178,576

[45] Dec. 11, 1979

[54] FEED SYSTEM FOR MICROWAVE ANTENNA EMPLOYING PATTERN CONTROL ELEMENTS

[75] Inventors: Daniel R. Schmidt, Jr., Park Forest; Joseph F. Busse, Calumet City, both of Ill.

[73] Assignee: Andrew Corporation, Orland Park, Ill.

[21] Appl. No.: 829,604

[22] Filed: Sep. 1, 1977

[51] Int. Cl.[2] ..... H01Q 19/14

[52] U.S. Cl. ..... 343/781 R; 343/840

[58] Field of Search ..... 343/781 R, 781 P, 840, 343/786, 833, 837, 838

[56] References Cited

U.S. PATENT DOCUMENTS

| | | | |
|---|---|---|---|
| 2,370,053 | 2/1945 | Lindenblad | 343/782 |
| 2,605,416 | 7/1952 | Foster | 343/781 P |
| 2,627,028 | 1/1953 | Nowak | 343/819 |
| 2,671,855 | 3/1954 | Van Atta | 343/782 |
| 2,759,182 | 8/1956 | Chaffee | 343/838 |

FOREIGN PATENT DOCUMENTS

| | | | |
|---|---|---|---|
| 209245 | 7/1957 | Australia | 343/772 |

*Primary Examiner*—Eli Lieberman

*Attorney, Agent, or Firm*—Leydig, Voit, Osann, Mayer & Holt, Ltd.

[57] ABSTRACT

A feed system for a dish-type microwave antenna has a primary radiator for directing a primary radiation pattern onto the dish-type antenna. A pair of symmetrical pattern control elements are aligned with the E plane of the antenna and extend radially outwardly from opposite sides of the axis of the primary radiator between the primary radiator and the antenna for increasing the antenna gain, reducing the sidelobe levels and reducing the half power beamwidth of the antenna in both the E and H planes. In an exemplary embodiment, the pattern control elements comprise metal strips mounted on the surface of a rigid coaxial cable extending along the axis of the primary radiator for transmitting microwaves to and from the primary radiator, and the metal strips are inclined toward the antenna.

9 Claims, 6 Drawing Figures

E PLANE

H PLANE

E PLANE
0
10dB
20dB
30dB
40dB
10°
5°
5°
10°
60°
30°
0°
30°
60°
A
B
C

H PLANE
0
10dB
20dB
30dB
40dB
10°
5°
5°
10°
60°
30°
0°
30°
60°
A
B
C

FEED SYSTEM FOR MICROWAVE ANTENNA EMPLOYING PATTERN CONTROL ELEMENTS

DESCRIPTION OF THE INVENTION

The present invention relates generally to microwave antennas and, more particularly, to a feed system for dish-type microwave antennas.

It is a primary object of the present invention to provide an improved feed system for a dish-type microwave antenna which improves the gain of the antenna while reducing the half power beamwidth in both the E and H planes. In this connection, a related object of the invention is to provide such an improved feed system which distributes the primary pattern more uniformly over the surface of the antenna.

It is another object of this invention to provide such an improved feed system for a dish-type microwave antenna which reduces the sidelobes.

A further object of the invention is to provide such an improved feed system which permits certain standard dish-type antennas to be easily and economically modified to meet a more stringent specification than the unmodified standard antenna.

Still another object of this invention is to provide such an improved feed system which can be efficiently and economically manufactured.

Other objects and advantages of the invention will be apparent from the following detailed description and the accompanying drawings.

In accordance with the present invention, a feed system for a dish-type microwave antenna comprises a primary radiator for directing a primary radiation pattern onto the dish-type antenna, and a pair of symmetrical pattern control elements aligned with the E plane of the antenna and located on opposite sides of the axis of the primary radiator between the primary radiator and the antenna for increasing the antenna gain, reducing the sidelobelevels and reducing the half power beamwidth of the antenna in both the E and H planes.

Figure 1:
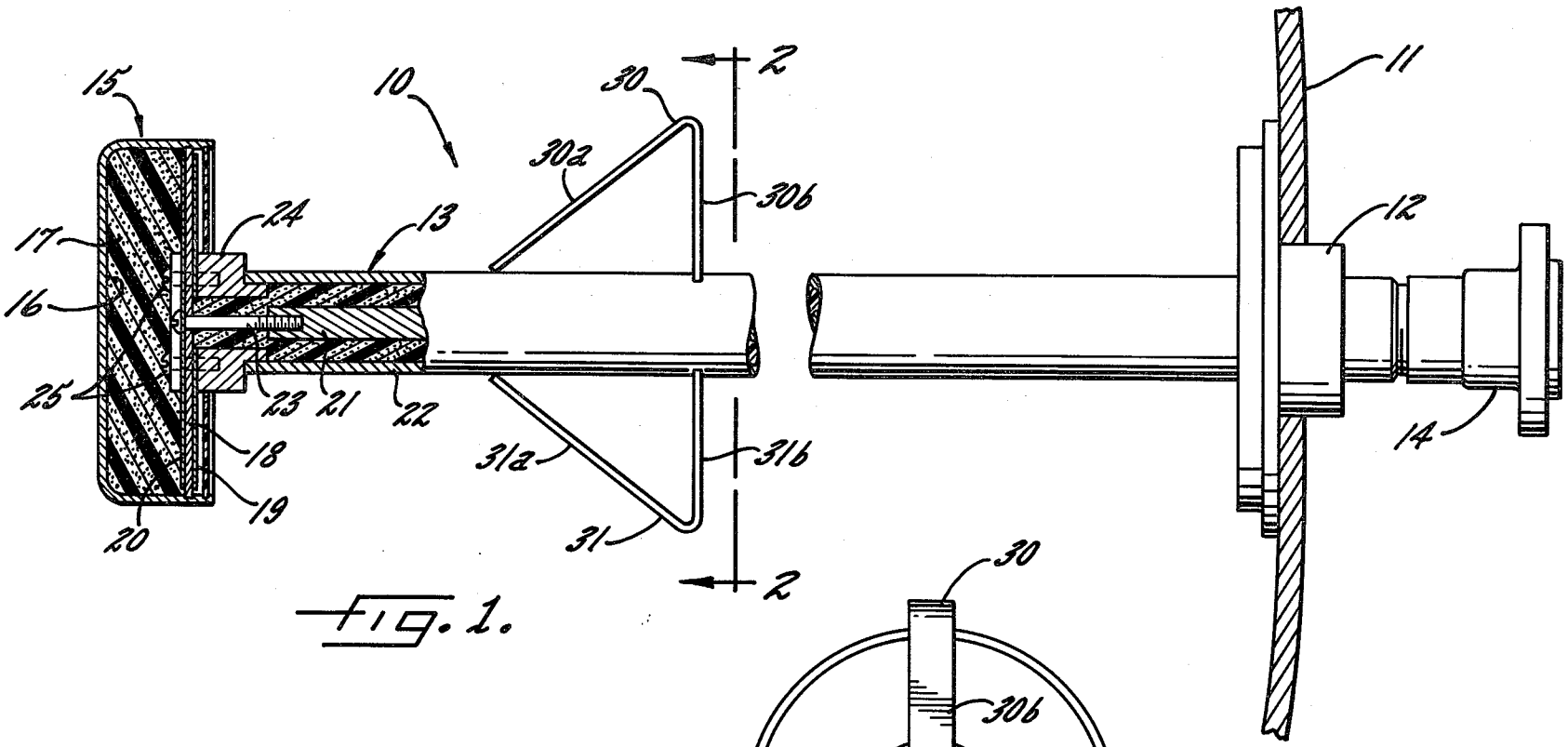
FIG. 1 is a side elevation, partially in section, of a microwave antenna feed system embodying the invention.
Figure 2:
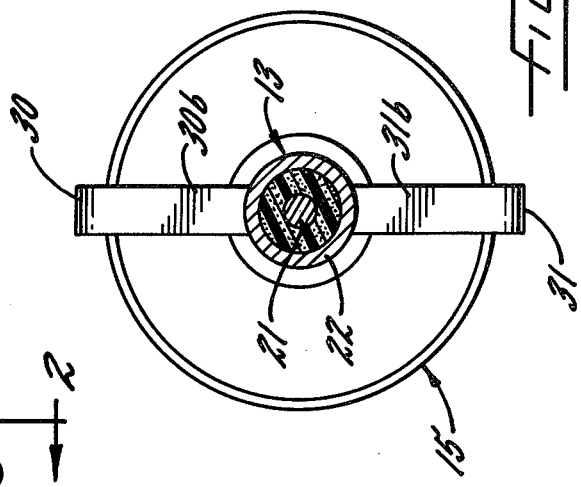
FIG. 2 is a section taken along line 2—2 in FIG. 1.
Figure 3:
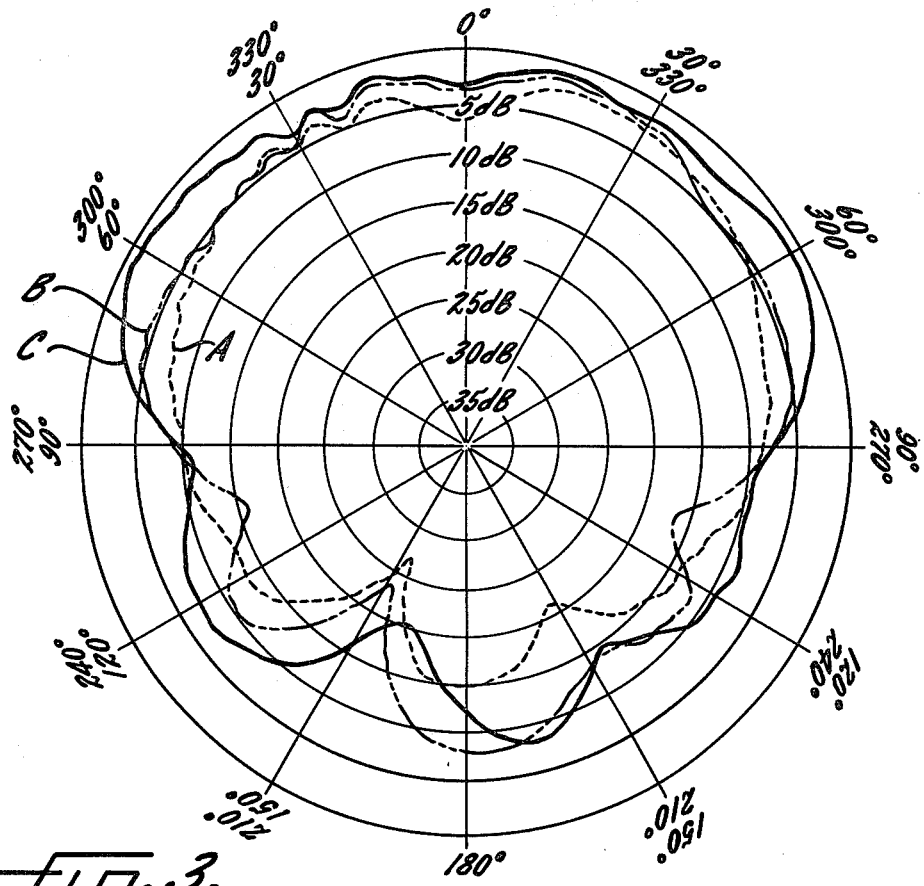
Figure 4:
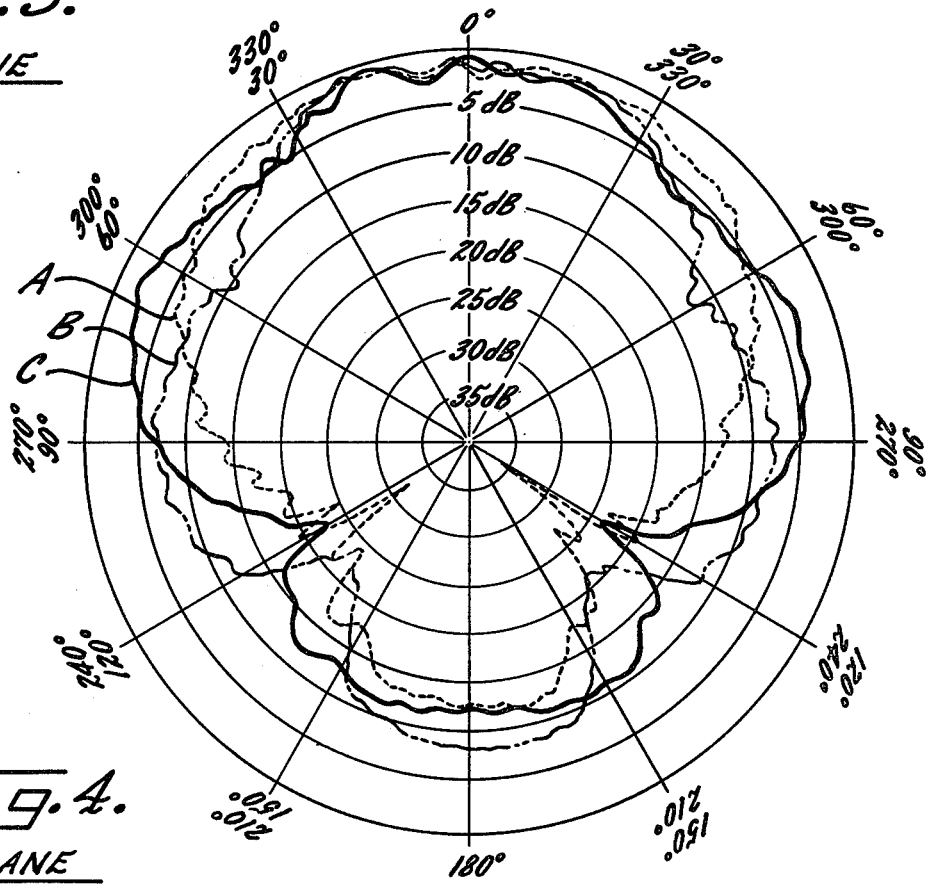
Figure 5:
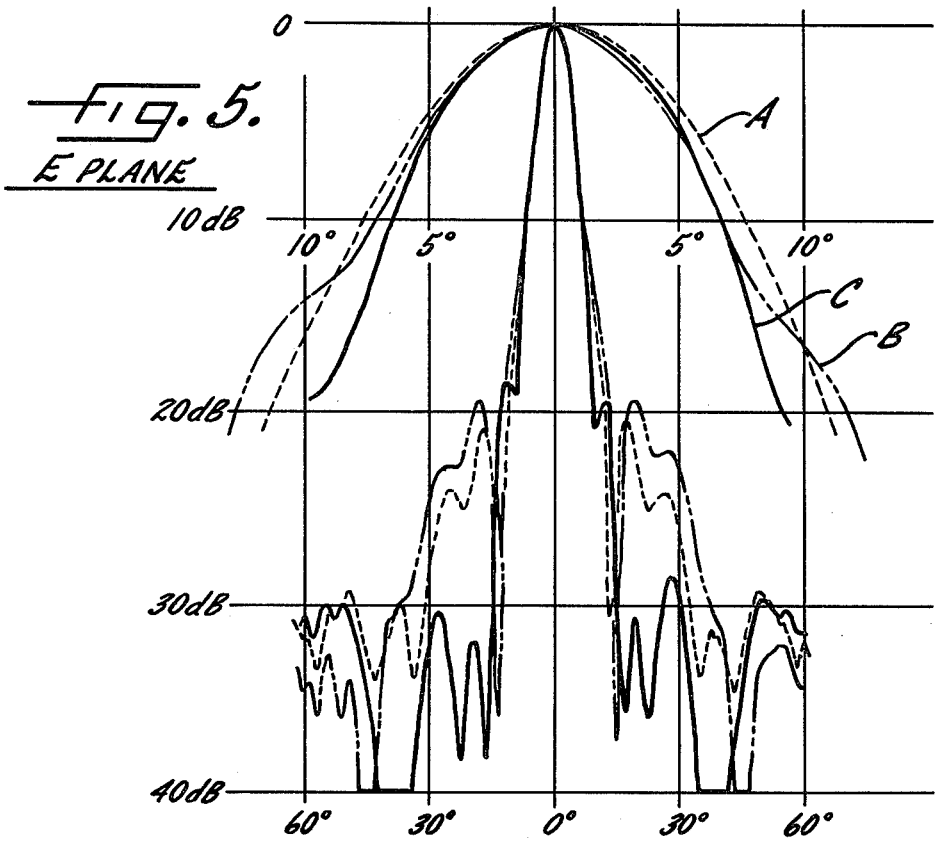
Figure 6:
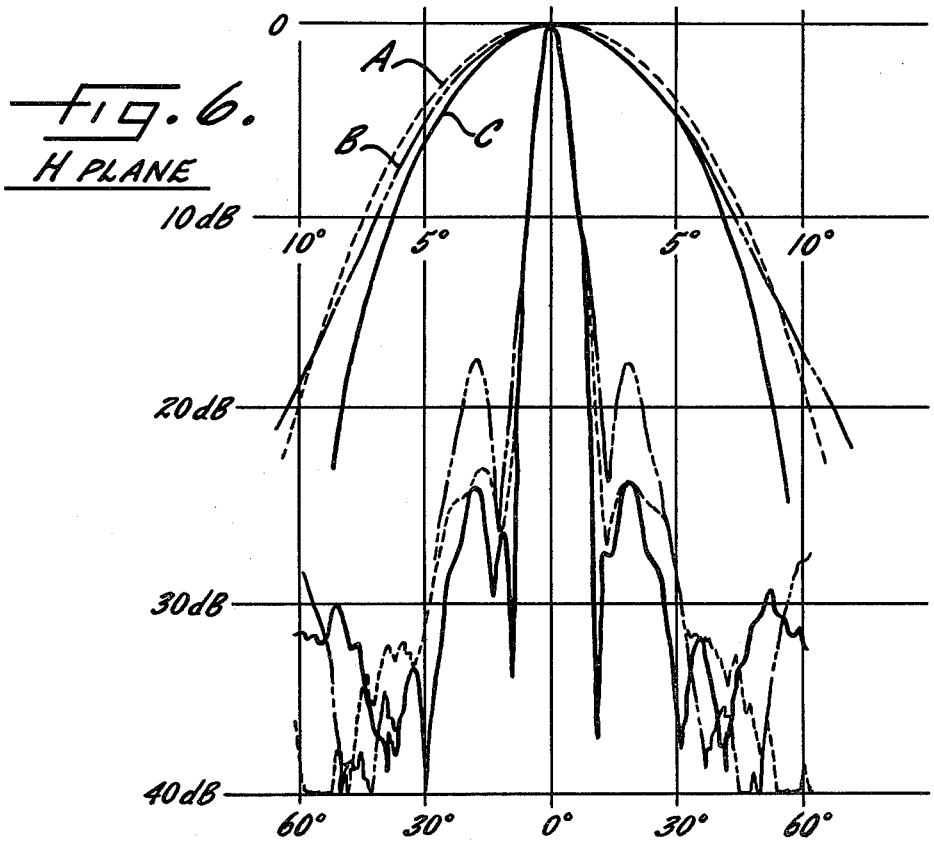

FIGS. 3 and 4 are polar plots of primary patterns produced at 2.1 GHz in the E and H planes, respectively, by the feed system of FIGS. 1 and 2 and by two different prior art feed systems; and FIGS. 5 and 6 are far field radiation patterns of the main beam and first few sidelobes of a four-foot parabolic antenna at 2.1 GHz in the E and H planes, respectively, using the same three feed systems used to produce the primary patterns of FIGS. 3 and 4.

While the invention will be described in connection with certain preferred embodiments, it will be understood that it is not intended to limit the invention to these particular embodiments. On the contrary, it is intended to cover all alternatives, modifications and equivalents as may be included within the spirit and scope of the invention as defined by the appended claims.

Turning now to the drawings and referring first to FIGS. 1 and 2, there is shown a coaxial feed 10 mounted from the center of a parabolic dish-type antenna 11. A mounting collar 12 is fastened to the center of the antenna dish 11 for positioning the feed assembly, with a rigid coaxial cable 13 extending through the collar 12 and a central aperture in the antenna dish 11 for connection to a conventional cable connector 14 behind the antenna 11. This rigid coaxial cable 13 serves as a support boom for the feed assembly and supplies radio frequency signals to a primary radiator 15 which directs a primary pattern of microwaves onto the antenna 11. As will be understood by those familiar with this art, the primary radiator 15 is located at the focal point of the parabolic antenna dish 11.

The illustrative primary radiator 15 comprises a cup-shaped metal cavity 16 filled with a foam dielectric 17, with the open end or mouth of the cup 16 being closed by a circular printed circuit board 18. Printed conductor patterns 19 and 20 are formed on the front and rear surfaces, respectively, of the printed circuit board 18 for connection to the outer and inner conductors 22 and 21, respectively, of the coaxial cable 13. More specifically, the inner conductor 21 is connected to the printed conductor pattern 20 on the board 18 by means of a connector pin 23 threaded into the end of the inner conductor 21. The outer conductor 22 is connected to the printed conductor pattern 19 through a conductive sleeve 24 which is fastened to the printed circuit board 18 by means of a plurality of screws 25.

The particular configurations of the conductor patterns 19 and 20 formed on the printed circuit board 18 do not form a part of the present invention and need not be described in detail herein. Exemplary printed conductor patterns for this purpose are described in more detail in the assignee's Phillips U.S. Pat. No. 3,771,161 issued Nov. 6, 1973 for "Printed-Circuit Feed For Reflector Antennas."

In accordance with one important aspect of the present invention, a pair of symmetrical pattern control elements aligned with the E plane of the antenna are located on opposite sides of the axis of the primary radiator between the primary radiator and the antenna for increasing the gain, reducing the sidelobes and reducing the half power beamwidth of the antenna in both the E and H planes. Although the two pattern control elements lie in the E plane of the primary pattern, it has been surprisingly found that these control elements improve the half power (3dB) beamwidth in both the E and H planes while also improving the antenna gain. In fact, the half power beamwidth is generally improved more in the H plane that in the E plane. Furthermore, the magnitude of the improvement is sufficient to upgrade a given antenna from one category to the next higher category according to government specifications. For example, certain government specifications require a maximum 3dB beamwidth of 5° for category "A" antennas in the 1.850 to 2.690 GHz frequency range and 8° for category "B" antennas. Thus, by reducing the 3dB beamwidth from the range of 5°–8° to less than 5°, the antenna can be upgraded from category "B" to category "A". Similarly, by reducing the 3dB beamwidth from above 8° to less than 8°, a non-qualifying antenna can qualify for category "B".

In the illustrative embodiment of FIGS. 1 and 2, the pattern control elements are in the form of a pair of brass strips 30 and 31 mounted on opposite sides of the coaxial feed in alignment with the E plane of the antenna. If desired, the strips can be made of a conductive metal other than brass. The illustrative strips 30 and 31 are bent to form triangles when attached to the coaxial feed. The operative portions of the strips 30 and 31 are the legs 30*a* and 31*a* which are inclined away from the axis of the coaxial feed and toward the antenna at an angle of 38.5° relative to the feed axis. The straight radial legs 30*b* and 31*b* of the strips are provided mainly for the purpose of rigidly supporting the inclined legs 30*a* and 31*a* in fixed positions on the coaxial feed.

Optimum results are generally obtained when the distance between the radially outermost points of the control elements 30 and 31 is about equal to one half wavelength, but this dimension may be varied somewhat depending on the desired results. Optimum results are also usually obtained when the axial distance between the face of the primary radiator 15 and the axial midpoint of the control elements 30 and 31 is about equal to one wavelength, but again this dimension may be varied somewhat if desired. The preferred width for the control elements 30 and 31 is approximately one twelfth wavelength, which is typically about 0.5 inch at 2 GHz.

The specific configuration of the pattern control elements is not narrowly critical. Thus, the angle of the inclined legs 30*a* and 31*a* to the axis of the coaxial feed may be varied, as may the shape of the strips. For example, rather than being flat strips that form an acute angle with the feed axis, the strips may be in the form of semi-circles or semi-rectangles.

FIGS. 3 and 4 are polar plots of the primary radiation patterns produced in the E and H planes, respectively, by three different feed systems. Curve A in each figure represents the pattern produced by a feed system of the type illustrated in FIGS. 1 and 2 but without the pattern control elements 30 and 31; curve B in each figure represents the pattern produced by a feed system of the type illustrated in FIGS. 1 and 2 with a single conical control element (as used in the prior art) mounted concentrically on the coaxial cable 13 and extending completely around the cable, in place of the control strips 30 and 31; and curve C in each figure represents the pattern produced by the feed system of the present invention as illustrated in FIGS. 1 and 2. The particular feed systems used to produce the primary patterns shown in FIGS. 3 and 4 were all designed for use with a four-foot parabolic antenna having a F/D ratio of 0.25, which utilizes a full 180° of the primary pattern, i.e., the entire top half of the patterns shown in FIGS. 3 and 4. It can be seen from FIGS. 3 and 4 that the feed system of the present invention (patterns C) distributed the primary pattern much more uniformly over the surface of the antenna, which improves the gain of the antenna.

FIGS. 5 and 6 are far field radiation patterns of the main beam and first few sidelobes of a four-foot parabolic antenna (F/D=0.25) fed by the primary patterns shown in FIGS. 3 and 4. The identifying letters A, B and C in FIGS. 5 and 6 represent the same feed systems identified by the corresponding letters in FIGS. 3 and 4. It can be seen from FIGS. 5 and 6 that the feed system of the present invention (Curve C) substantially reduced the sidelobes, thereby increasing the gain. The gains calculated for the feed systems that produced the three far field patterns illustrated in FIGS. 5 and 6, at 2.1 GHz from full patterns by the pattern integration method, were 26.16 dBi for the feed system that produced pattern A, 26.06 dBi for the feed system that produced pattern B, and 27.06 dBi for the feed system of the present invention that produced pattern C. Thus, although the conical pattern control element used to produce pattern B reduced the half power beamwidth, the antenna gain was decreased by that conical control element. This is in contrast to the control elements of the present invention, which reduce the half power beamwidth while at the same time increasing the gain.

In another series of tests, five different parabolic antennas ranging in diameter from 4 feet to 8 feet and with F/D ratios of either 0.250 or 0.375 were tested with the feed system of FIGS. 1 and 2 (a conventional coaxial horn feed was substituted for the printed circuit feed in the test of the second 6-foot antenna with an F/D of 0.375) and with an identical feed system without the pattern control elements 30 and 31. The second 6-foot antenna with an F/D of 0.375 was designed to operate in the range of 1.9 GHz to 2.3 GHz, and the others were all designed to operate in the range of 2.1 GHz to 2.2 GHz. All the antennas were tested at 2.1 GHz. The half power beamwidths measured for the antennas are set forth in the following table, in which column A under each antenna contains the results without the pattern control elements (corresponding to curves A in FIGS. 3–6) and column C contains the results obtained with the pattern control elements (corresponding to curves C in FIGS. 3–6). It can be seen that in each case the presence of the pattern control elements resulted in significant reductions in the half power beamwidth in both the E and H planes.

| | Six-foot Diameter | | | | | | Eight-Foot Diameter | | Four-Foot Diameter | |
|---|---|---|---|---|---|---|---|---|---|---|
| | F/D = 0.375 | | F/D = 0.250 | | F/D = 0.375 | | F/D = 0.375 | | F/D = 0.250 | |
| PLANE | A | C | A | C | A | C | A | C | A | C |
| E | 5.25 | 4.90 | 5.00 | 4.95 | 5.25 | 4.90 | 3.6 | 3.5 | 7.90 | 7.55 |
| H | 5.10 | 4.90 | 5.85 | 5.20 | 5.10 | 4.80 | 3.85 | 3.65 | 8.70 | 7.95 |

As can be seen from the foregoing detailed description, the present invention provides an improved microwave antenna feed system which improves the gain of the antenna while reducing the half power beamwidth in both the E and H planes. The pattern control elements provided by this invention distribute the primary pattern more uniformly over the surface of the antenna and also reduce the sidelobes. As can be seen from the foregoing data, this improved feed system permits certain standard dish-type antennas to be easily and economically modified to meet a more stringent specification than the unmodified standard antenna, simply by the addition of the pattern control elements. Furthermore, this feed system can be efficiently and economically manufactured, since the pattern control elements may be easily added to an otherwise conventional feed system.

We claim as our invention:

1. A dish-type microwave antenna having a feed system comprising (a) a prime-focus type radiator located at the focal point of the antenna for directing a primary radiation pattern onto the dish-type antenna, (b) and a pair of symmetrical pattern control elements aligned with the E plane of the antenna and extending radially outwardly from opposite sides of the axis of the primary radiator between the primary radiator and the antenna, the axial distance between the face of said primary radiator and the axial midpoint of said control elements being about the same as the wavelength of the microwaves radiated by said primary radiator to widen the primary pattern and distribute said pattern more uniformly over the surface of the antenna, thereby increasing the antenna gain and reducing the half power beamwidth of the antenna in both the E and H planes.

2. A dish-type antenna as set forth in claim 1 which includes a rigid coaxial cable extending along the axis of said primary radiator for transmitting radio frequency signals to and from the primary radiator, and said pattern control elements are mounted on the surface of said cable.

3. A dish-type antenna as set forth in claim 2 wherein said control elements comprise metal strips bent to form triangles with the surface of said cable.

4. A dish-type antenna as set forth in claim 1 wherein said pattern control elements comprise metal strips extending radially outwardly from the axis of the primary radiator.

5. A dish-type antenna as set forth in claim 4 wherein said metal strips are inclined toward the antenna.

6. A dish-type antenna as set forth in claim 4 wherein the width of said metal strips is about one twelfth of the wavelength of the microwaves radiated by said primary radiator.

7. A dish-type antenna as set forth in claim 1 wherein the distance between the radially outermost points of said control elements is about one half of the wavelength of the microwaves radiated by said primary radiator.

8. A dish-type antenna as set forth in claim 1 wherein the width of each of said control elements is about one half inch.

9. A dish-type antenna as set forth in claim 1 which includes at least one waveguide for transmitting microwaves to and from the primary radiator.

* * * * *